US008490858B2

(12) United States Patent
Timbrook et al.

(10) Patent No.: US 8,490,858 B2
(45) **Date of Patent: *Jul. 23, 2013**

(54) REINFORCED CROSS-LAMINATED BULK CONTAINER

(75) Inventors: Ronald D. Timbrook, Edgerton, OH (US); Ryan M. Myers, Auburn, IN (US); William F. Moss, Canonsburg, PA (US); Marty Patrickus, Hazelhurst, WI (US)

(73) Assignee: International Paper Company, Memphis, TN (US)

( * ) Notice: Subject to any disclaimer, the term of this patent is extended or adjusted under 35 U.S.C. 154(b) by 507 days.

This patent is subject to a terminal disclaimer.

(21) Appl. No.: 12/755,887

(22) Filed: Apr. 7, 2010

(65) Prior Publication Data

US 2011/0248080 A1 Oct. 13, 2011

(51) Int. Cl.
*B65D 5/50* (2006.01)

(52) U.S. Cl.
USPC ..... 229/122.32; 229/155; 229/157; 229/199; 229/939

(58) Field of Classification Search
USPC ..... 229/122.32, 122.33, 155–157, 199, 229/939; 206/386, 600
See application file for complete search history.

(56) References Cited

U.S. PATENT DOCUMENTS

| | | | | |
|---|---|---|---|---|
| 1,527,021 | A * | 2/1925 | Wandel | 229/199 |
| 1,809,953 | A * | 6/1931 | Witte | 229/939 |
| 3,063,615 | A * | 11/1962 | Bronte et al. | 229/122.32 |
| 3,185,045 | A | 5/1965 | Bronte et al. | |
| 3,873,017 | A * | 3/1975 | Blatt | 229/939 |
| 4,398,650 | A * | 8/1983 | Holmes et al. | 229/939 |
| 4,585,143 | A | 4/1986 | Fremow et al. | |
| 4,693,413 | A | 9/1987 | McFarland et al. | |
| 4,702,408 | A * | 10/1987 | Powlenko | 229/199 |
| 4,793,550 | A * | 12/1988 | Gottlieb | 229/199 |
| 4,964,561 | A | 10/1990 | Whelan | |
| 5,046,662 | A | 9/1991 | Cowles | |
| 5,104,035 | A | 4/1992 | Rosenbaum, II | |
| 5,351,849 | A * | 10/1994 | Jagenburg et al. | 229/122.33 |
| 5,772,108 | A * | 6/1998 | Ruggiere et al. | 229/199 |
| 6,076,730 | A | 6/2000 | Boutin et al. | |
| 6,076,734 | A | 6/2000 | Dougherty et al. | |
| 6,293,460 | B1 | 9/2001 | Boutin et al. | |
| 7,172,108 | B2 | 2/2007 | Ingalls | |

(Continued)

FOREIGN PATENT DOCUMENTS

| | | |
|---|---|---|
| DE | 29721079 | 3/1998 |
| FR | 2403271 | 4/1979 |
| FR | 2677609 | 12/1992 |

*Primary Examiner* — Gary Elkins
(74) *Attorney, Agent, or Firm* — Matthew M. Eslami

(57) ABSTRACT

A reinforced cross laminated corrugated paperboard bulk container has an outer component with corrugations running in a first direction, and an inner liner laminated to the outer component, with the liner having corrugations extending perpendicular to the corrugations in the outer component. Reinforcing strands are in both the liner and the outer component, extending perpendicular to the respective corrugations thereof. Interlocking top flanges are on the top edges of the outer component, and interlocking bottom flanges are on the bottom edges thereof. The interlocking bottom flanges include a chevron shaped locking slot in one flange and a locking tab on an opposed bottom flange. Folds extend across the bottom flanges to enable them to deflect and slide relative to one another during set up of the container. Vertical scores in the liner are pre-broken prior to laminating it to the outer component.

20 Claims, 4 Drawing Sheets

U.S. PATENT DOCUMENTS

2002/0096559 A1 7/2002 Quaintance
2003/0132275 A1 7/2003 Ingalls
2006/0163333 A1 7/2006 Kornacki
2006/0169757 A1* 8/2006 McDowell ..... 229/122.33
2007/0257094 A1* 11/2007 Jackson et al. ..... 229/199
2010/0230480 A1 9/2010 Southwell et al.
2012/0104083 A1 5/2012 Timbrook et al.

* cited by examiner

REINFORCED CROSS-LAMINATED BULK CONTAINER

TECHNICAL FIELD

This invention relates generally to bulk shipping and storage containers. More particularly, the invention relates to a bulk container made of reinforced cross-laminated corrugated paperboard. In a preferred embodiment the container has interlocking full bottom flaps and is especially adapted for containing fluid products.

BACKGROUND ART

In the bulk handling of materials, and especially fluid or flowable materials such as liquids, powders and granules, containers of 20 to 80 gallon capacity are commonly used to transport and store the material. These containers should be capable of withstanding the weight of the contents and of being stacked on top of one another. They should also be capable of withstanding the rough handling to which they may be subjected, and be capable of being handled with mechanized equipment.

A variety of containers have been developed in the prior art in an effort to meet these criteria, including drums made of metal or fibre, plywood bins, and corrugated paperboard containers. While plywood bins and drums made out of metal or fibre possess the requisite strength and durability, they are expensive to manufacture, store and ship.

Corrugated paperboard containers are less costly to make and generally can be collapsed for compact storage and shipment. However, when filled with a fluid product the sidewalk of the container may bulge outwardly, and depending upon the size of the container and weight of the material used in its construction it may be difficult to set up. Further, a flexible bag liner is commonly used when a fluid material is to be contained, and unless special consideration is given to how the container is constructed, the liner may be damaged by elements of the container protruding into the interior of the container.

Bulk containers may be palletized for ease and convenience of handling, and it is desirable that the container or containers efficiently fit the pallet, i.e. that they do not overhang the edges of the pallet, or the edges of the pallet do not extend an excessive distance beyond the perimeter of the container or containers supported thereon. Pallets typically utilized are 40×48 or 44×44 or 44×54 inches in size and are square or rectangular in shape. Cylindrical drums do not efficiently fit a pallet because the circular footprint of the drum leaves void spaces between adjacent drums and at the corners of the pallet. Conventionally constructed square or rectangular containers of corrugated paperboard can be sized to fit a pallet, but if the sidewalls bulge outwardly they can extend beyond the perimeter of the pallet and be subject to damage.

Conventional corrugated paperboard containers strong enough to hold fluid material are either difficult to set up from a flattened condition and/or are too hard to manufacture and/or are too expensive for the end-user. Bulging sidewalls and difficulty in setting them up from a knocked down or flattened condition are the major problems with conventional designs.

There is need, therefore, for a bulk container made of corrugated paperboard that can take the place of a 20 to 80 gallon fibre drum or metal barrel, which can ship flat and be easily opened up for filling, and once it is empty, knocked down flat again for either re-use or recycling. Further, it would be desirable to have a container that can fit four on a pallet, that is reinforced against bulging of the sidewalls, and that maintains proper containment thereby eliminating potential contamination.

DISCLOSURE OF THE INVENTION

The present invention solves the foregoing problems through a combination of features, including cross lamination of a corrugated inner liner and an outer component, double score profiles on the 180 degree folds, use of re-enforcing tape such as Sesame Tape or a comparable re-enforcing strand in the liner and in the outer component, with the reinforcing tape extending perpendicular to the respective corrugations in the liner and in the outer component, and pre-breaking of the scores in the liner before lamination with the outer component. The cross lamination of the inner liner and outer component, together with the cross-hatch pattern created by the direction of the reinforcing tape or strands, fortifies the sidewalls against bulge and permits use of lower grades of material in the cross corrugation liner.

In a preferred embodiment of the invention the container is sized so that four of them can fit on a single pallet. Although the structural limit to a container is governed by the machines used to produce the corrugated fibreboard and the laminator with which the components are joined, the smaller size containers are difficult to fabricate so that they can be shipped in a knocked down condition and easily erected by the user. Pre-breaking the scores of the cross laminated inner liner before it is laminated to the outer component provides ease of fabrication and makes it easier for the end-user to open up the container from a knocked down condition. By pre-breaking the scores deeper definition is given to the body scores and the surface tension is reduced when the panels are folded to form the container. In accordance with the invention, an inner jig is employed during the folding operation at the point of closing the glue joints on the container. The jig helps to form a more uniform geometry by forcing the 180 degree fold ends into two 90 degree pairs of double score features at the vertical corners of the container.

The resistance to folding of bulk containers, especially the smaller sizes that are in high demand, is of paramount concern, and has been one of the major weaknesses of previous designs. Resistance to folding is created by the small panel sizes and the laminated construction. To overcome this resistance in the present invention, the scores in the inner liner are pre-broken before the liner is laminated to the outer component, and double scores are placed at the point of the 180 degree folds. The double scores lessen the surface tension on the outermost facing, and each of the double scores, individually, only has to fold 90 degrees in the container of the invention, together forming the 180 degree fold.

In a preferred embodiment the container of the invention has an interlocking bottom flap construction that minimizes the risk of failure during handling, and avoids pinching of a bag liner when a bag is used. The interlocking bottom flaps are designed to provide trouble-free continuous performance during handling even when liquids are stored in the container. The interlocking bottom flaps include a pair of opposed intermediate or inner flaps that provide a full overlap on the inside of the container bottom, with a smooth surface to prevent pinching a bag liner and causing a leak when a bag is used inside the container. Both intermediate flaps have perf scores (also known as cut and crease) just past the points of overlap of the intermediate flaps to assist the user in moving the flaps to their operative positions by preventing binding on the outer flaps which interlock. The interlocking structure of the outer flaps comprises a narrowed tab on the end edge of one outer flap, and a shaped slot adjacent the end edge of the opposing outer flap. The tab has rounded corners to allow entry into the opposing slot, and the shape of the slot inhibits bending of the tab during use. The outer flap that contains the slot also has angled perf scores to facilitate bending of this flap down into the container far enough to permit the tab to be engaged in the slot during set-up. Once engaged, the two interlocked flaps are pulled back up to create a stable flat surface on which the container rests during use. The shaped slot incorporates an arc so that the slot has a generally chevron shape, rather than the typical linear or rectangular geometry that is commonly seen in similar interlocks. Conventionally shaped slots apply force in a straight line across the tab when excessive force is exerted against it from product inside the container, causing the tab to bend. The chevron shape of the slot of the invention helps prevent bending of the tab by dispersing the excessive pressures in a non-linear pattern.

The liner can be any flute combination, such as C, B, A, AA, AC, BC, AB, AAA, ACA, CAA, CBA, etc, and combinations thereof. The outer half-slotted-container (HSC) of the invention also can comprise any of the same flute combinations. Selection of the flute combinations is governed by the desired performance level of containment and stacking strength.

The container of the invention can have any dimensions and any rectangular shape tailored to whatever a customer may want, being limited only by a manufacturer's ability to fabricate the container with the attributes of the invention disclosed herein.

Although the preferred construction has an interlocking, full overlapping bottom flap construction, it could comprise a set of partial flaps or flanges, if desired. A full bottom could also be constructed, but without the overlap that normally would be used in an application for liquid transport.

The preferred embodiment of container according to the invention has interlocking flanges at its upper end, but it could be constructed with no flaps or flanges at its upper end, or partial flaps without interlocking characteristics, or a full flap closure with or without any overlap. The preferred embodiment comprises interlocking flanges such as shown in U.S. Pat. No. 6,076,734, the disclosure of which is incorporated in full herein by reference. Interlocking top flanges in combination with the other features described earlier aids in the needed sidewall rigidity, and in turn helps prevent bulging and ensures proper product containment. Proper containment is necessary for secure storage and transport, whether the product is a food or an industrial ingredient.

Although the preferred embodiment has two reinforcing strands of tape (Sesame Tape or comparable types or brands) on the outer component and four strands on the cross laminated inner liner, the container of the invention could have any number of reinforcing strands, from no strands to eight strands per component, limited by the functionality for customer use and the manufacturer's ability to produce.

Further, a variety of flute configurations and combinations of the outer corrugated and the inner cross laminated corrugated could be used, such as singlewall (A-flute, B-flute, C-flute or any other flute size currently available) outer, and a cross laminated triplewall (AAA, ACA, CAA, CBA or any other flute combination currently available) inner. The inner cross corrugation could be any flute combination of doublewall and still provide adequate flexural rigidity which is needed for the practical use of the container.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
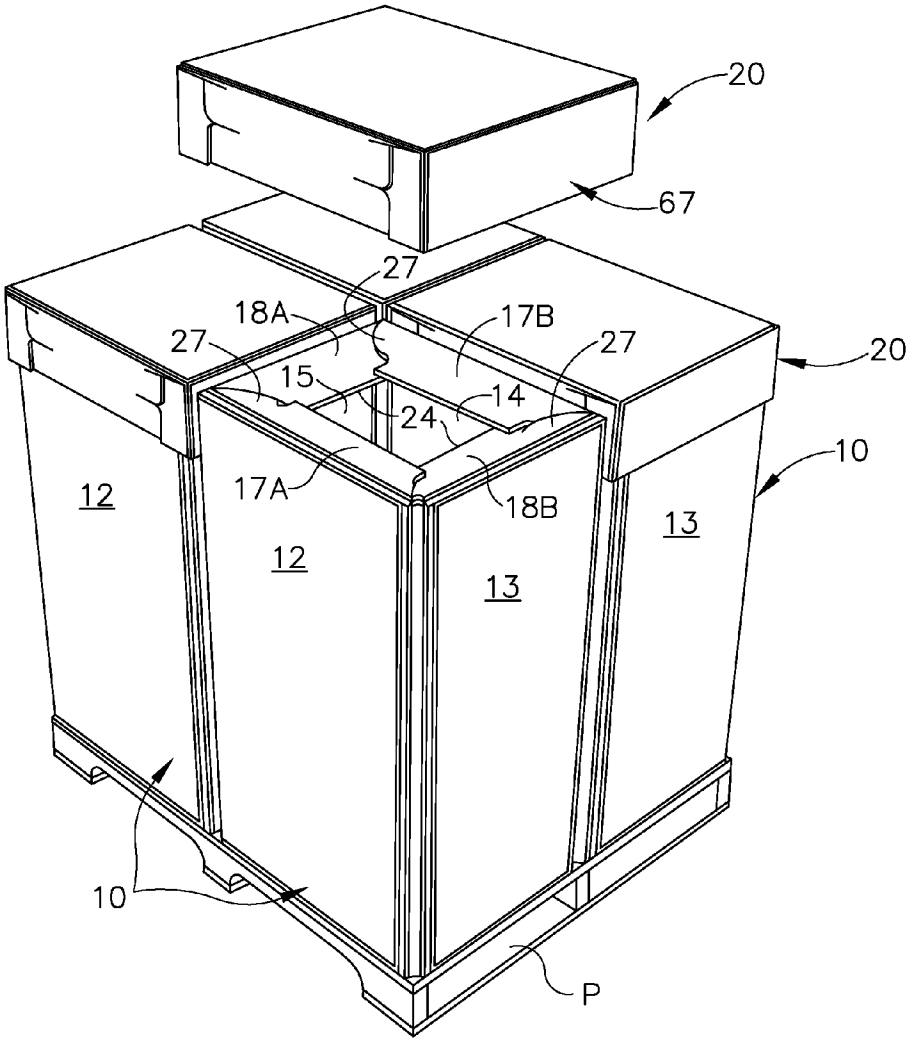
FIG. 1 is a partially exploded top perspective view of four containers according to the invention resting on a pallet.

A container made in accordance with a preferred embodiment of the invention is indicated generally at 10 in FIG. 1, wherein four of the containers are shown resting on a pallet P.

Figure 6:
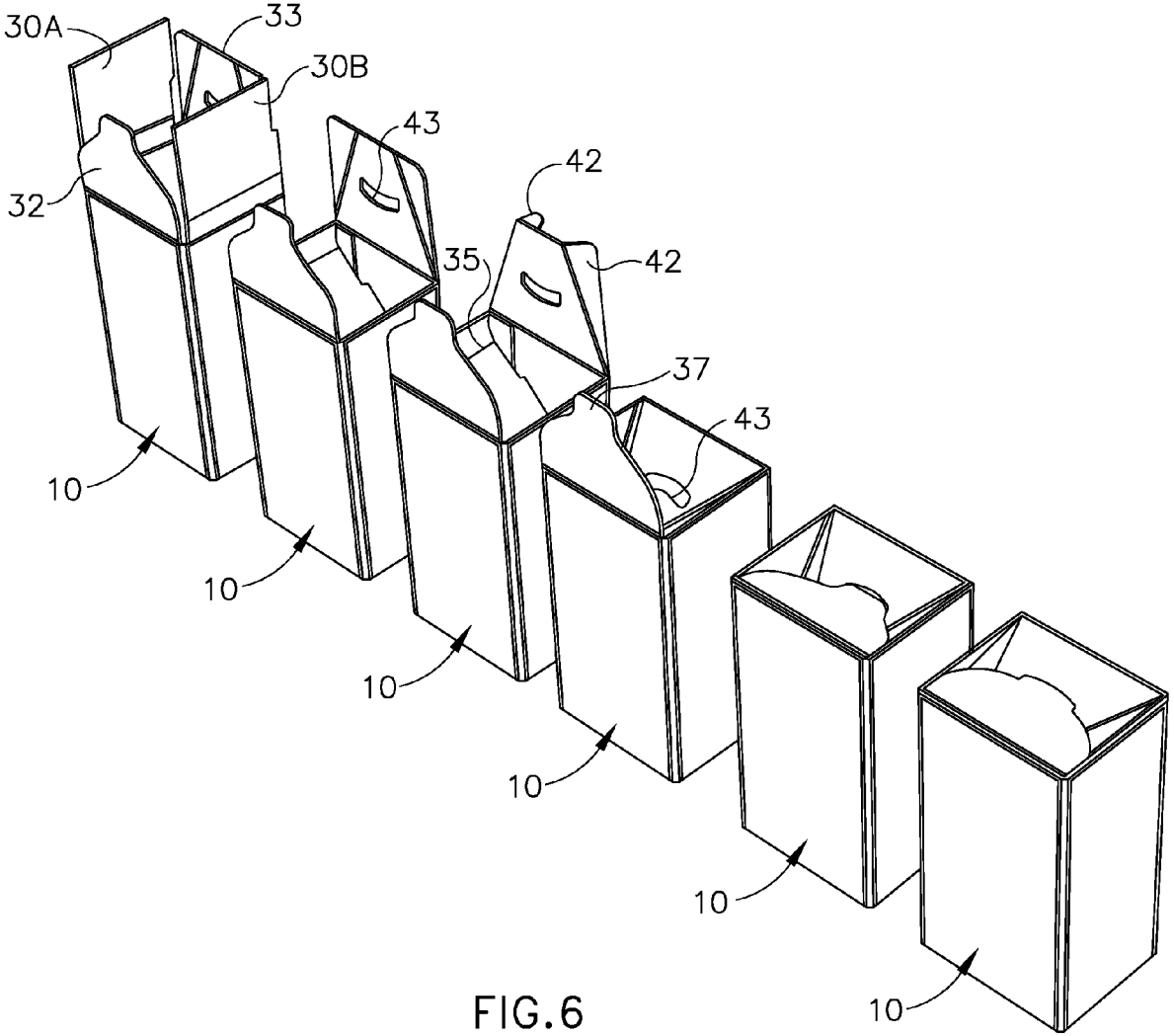
FIG. 6 shows the container in an inverted position and depicts the series of steps performed in folding the interlocking bottom flaps into operative interlocked position.

The container is rectangular in shape and has four sidewalls 12, 13, 14 and 15, joined together along vertical scores 16A, 16B, 16C and 16D at the corners, an open top end partially closed by interlocking top flanges 17A, 17B and 18A, 18B, and as seen best in FIG. 6 a closed bottom end 19. A cap 20 is placed over the upper end of each container and in FIG. 1 is shown removed from one of them.

Construction of the container is best understood with reference to FIGS. 2-6.

Figure 2:
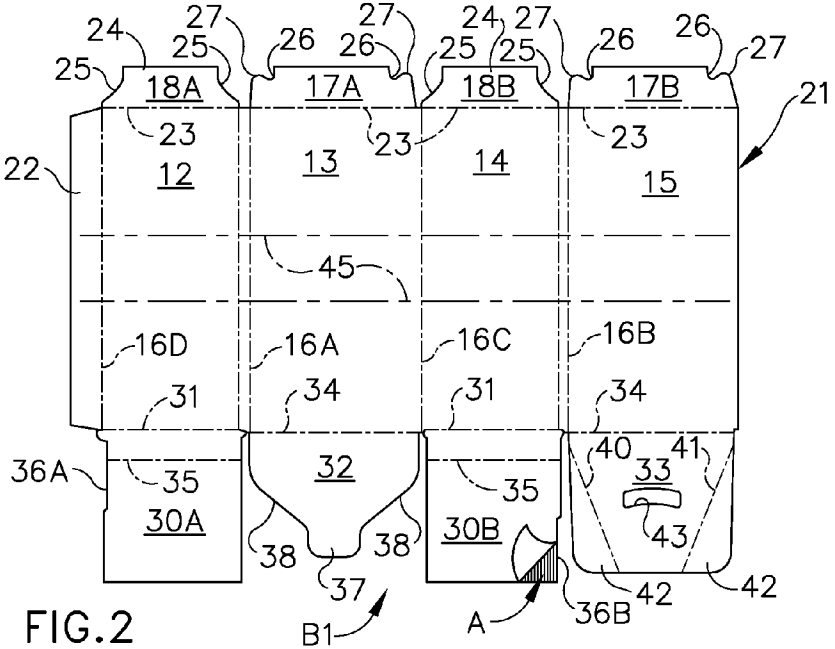
FIG. 2 is a top plan view of a blank for making the outer component of the container of the invention.

FIG. 2 shows a blank B1 for making the outer component 21 of the container. The blank comprises four sidewall panels 12, 13, 14 and 15 joined together along the respective scores 16A, 16B and 16C, with a glue flap 22 foldably joined to one end edge of the blank along fold 16D which effectively joins panel 12 to panel 15 when the container is glued up. The scores 16A and 16B are double scores as more fully described and illustrated in applicant's prior U.S. Pat. No. 4,693,413, the disclosure of which is incorporated in full herein by reference. As described in that patent, the scores 16A and 16B extend along those corners joining sidewall panels that move through 180 degrees between the unfolded position of the blank and the folded flat position of a container made from the blank.

The partial top flanges 17A, 17B and 18A, 18B are foldably joined to top edges of the respective sidewall panels along fold lines 23. The top flanges are constructed substantially the same as and function in substantially the same way as described and shown in applicant's prior U.S. Pat. No. 6,076,730, the disclosure of which is incorporated in full herein by reference. Thus, opposite side edges of flanges 18A and 18B are cut away along curvilinear lines to define a locking tab 24 on the outer end edge thereof and rounded shoulders 25 on the opposite side edges. Flanges 17A and 17B have notches 26 cut in their outer end edges adjacent the opposite sides thereof, defining rounded corners 27 on opposite side edges of the flanges. As seen best in FIG. 1, when the flanges are folded into operative position the corners 27 on flanges 17A, 17B engage beneath shoulders 25 on flanges 18A, 18B, and the side edges of tabs 24 engage in the notches 26, with the tabs 24 on flanges 18A, 18B lying beneath the adjacent edges of flanges 17A, 17B, interlocking the flanges together. It will be noted that the notches 26 and corners 27 in the present invention are rounded as distinguished from the rectilinear shape of these elements in U.S. Pat. No. 6,076,730, facilitating alignment and engagement of the interlocking portions of the flanges when they are being folded into their interlocking positions.

In the preferred embodiment shown in FIG. 2, substantially identical bottom flaps 30A and 30B are foldably joined to bottom edges of respective sidewall panels 12 and 14 along folds 31, and bottom flaps 32 and 33 are foldably joined to bottom edges of respective sidewall panels 13 and 15 along folds 34. In a container erected from the blank the flaps 30A and 30B comprise inner flaps and the flaps 32 and 33 comprise outer flaps.

The flaps 30A and 30B are rectangular in shape, and a line of perforations define a perf score 35 across each flap adjacent but spaced from the folds 31. When a container is erected from the blank, the flaps 30A, 30B are disposed in opposed relationship to one another and each flap extends most of the way across the bottom of the container, with the free end edge of each flap terminating just short of a respective perf score 35 in the opposed flap. This arrangement helps facilitate folding of the flaps into operative position as depicted in FIG. 6. The side edge of flap 30A is recessed slightly at 36A adjacent glue flap 22, and one side edge of flap 30B is recessed slightly at 36B adjacent its outer end edge. These recessed areas provide clearance for the glue flap when the flaps are folded into their operative positions in a container erected from the blank The side edges of flap 32 are cut away along curvilinear lines to define a narrowed locking tab 37 on the outer end edge thereof, and rounded shoulders 38 on opposite side edges. The locking tab and shoulders cooperate with flap 33 as described below to lock the bottom flaps in operative position across the bottom of a container erected from the blank.

Bottom flap 33 is generally rectangular in shape and a pair of diagonal fold scores 40 and 41 extend from opposite corners of the flap closely adjacent the fold 34 to the outer end edge thereof in inwardly spaced relation to opposite side edges of the flap, defining triangularly shaped corners 42. A generally chevron shaped slot 43 is formed in approximately the middle of the flap 33 for receiving the locking tab 37 on flap 32 as described hereinafter.

In the preferred embodiment as shown in FIG. 2, a pair of reinforcing strands 45 of Sesame Tape or other reinforcing strand known in the art extends across the blank from one end edge to the other approximately midway between the top and bottom edges thereof. As indicated by the arrow "A" in FIG. 2, the corrugations of the outer component 21 extend perpendicular to the top and bottom edges of the blank, and the reinforcing strands extend perpendicular to the corrugations.

Figure 3:
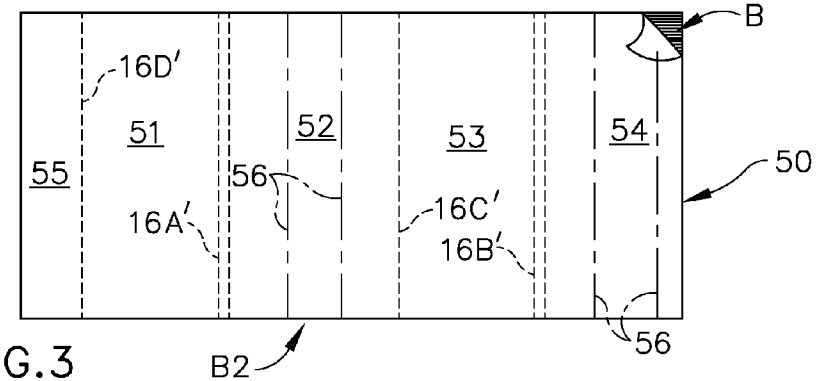
FIG. 3 is a top plan view of a blank for making the inner liner of the container of the invention.

A blank B2 for making the inner liner 50 of the container of the invention is shown in FIG. 3. The blank B2 is rectangular in shape and comprises four sidewall panels 51, 52, 53 and 54 joined together along respective scores 16A', 16B' and 16C', with a glue flap 55 foldably joined to one end edge of the blank along fold 16D' and which effectively joins panel 51 to panel 54 when the container is glued up. The scores 16A' and 16B' are double scores as more fully described and illustrated in applicant's prior U.S. Pat. No. 4,693,413, the disclosure of which is incorporated in full herein by reference. In a container erected from the blank, the scores 16A' and 16B' in the liner extend contiguous with the scores 16A and 16B in the outer component, and the scores 16C', 16D' extend contiguous with the scores 16C, 16D, respectively. The scores 16A', 16B', 16C' and 16D' in the liner are pre-broken with a jig (not shown) prior to lamination of the liner 50 to the outer component 21 to facilitate fabrication of the container and to make it easier for a user to open up a flattened container into its operative position. In the preferred embodiment as shown in FIG. 3, a first pair of reinforcing strands 56 of Sesame Tape or other reinforcing strands known in the art is applied to a midportion of sidewall panel 52, extending from the bottom edge thereof to the top edge, and at least one reinforcing strand 56 (two are shown in FIG. 3 and one in FIG. 5) is applied to a midportion of panel 54, extending from the bottom edge to the top edge of that panel. As indicated by the arrow "B", it will be noted that the corrugations in the liner extend in a direction perpendicular to the corrugations in the outer component. Thus, the reinforcing strands in the liner extend perpendicular to the corrugations in the liner, and as seen best in FIG. 5 they extend perpendicular to the reinforcing strands in the outer component in a container erected from the blank.

Figure 5:
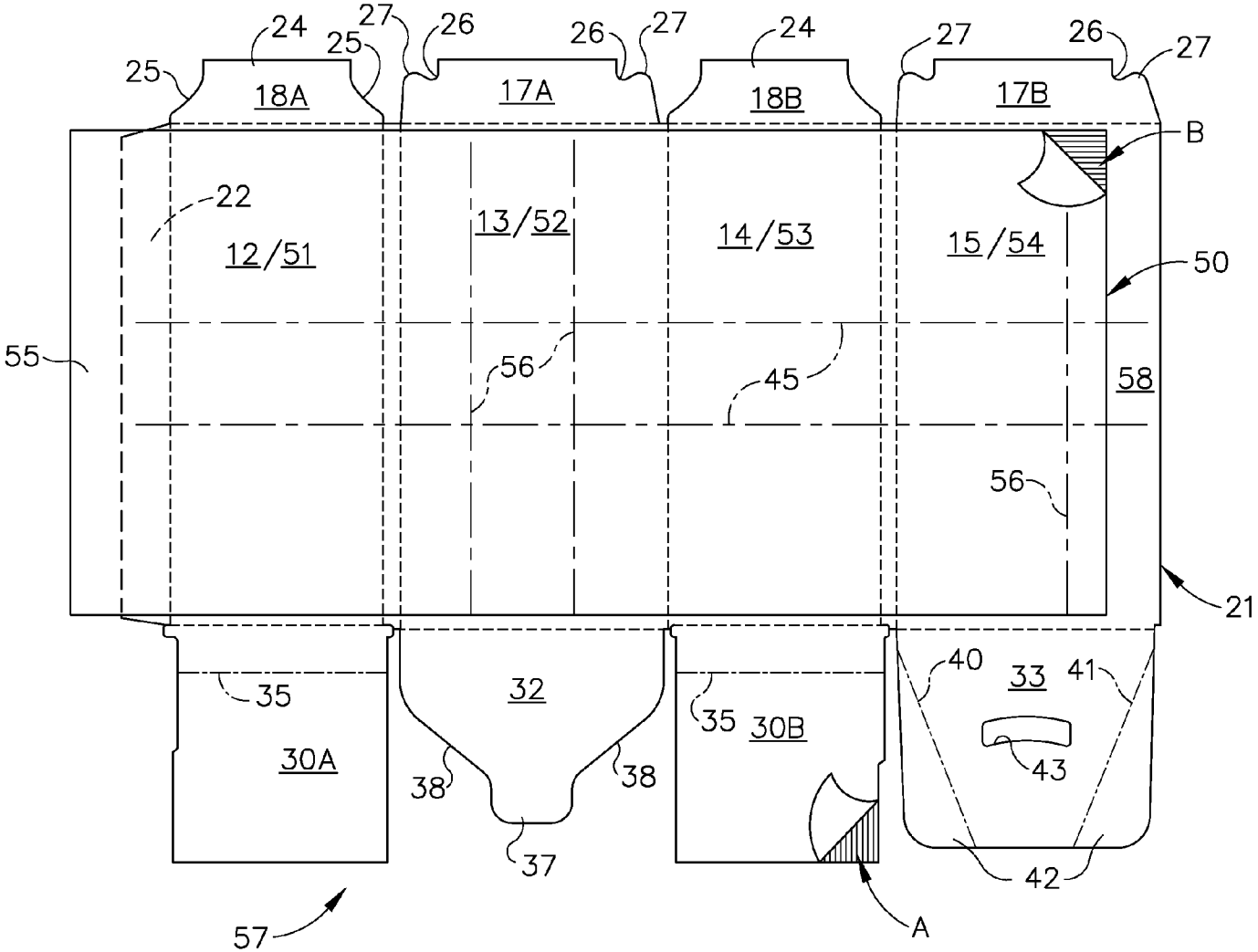
FIG. 5 is a top plan view showing the inner liner laminated to the outer component preparatory to folding the container and gluing the glue flaps together.

FIG. 5 shows the inner liner 50 laminated to the outer component 21 to form a laminated blank 57 from which the container is erected. It will be noted that the liner is shifted to the left as viewed in this figure, with the glue flap 55 on the liner projecting beyond the glue flap 22 on the outer component, and the opposite end of the liner inset relative to the adjacent end of the outer component, defining a space 58 for attachment of the glue flap 55.

To set up a container from its flattened condition to its expanded operative condition, it is opened into a tubular configuration and the partial top flaps are folded into their operative interlocked position as described previously herein. The container is then inverted so that it rests on its top end, and the bottom flaps are folded into their operative interlocked positions as depicted in FIG. 6. Flaps 30A and 308 are first folded inwardly into the container, followed by inward folding of flap 33 and then flap 32. The flaps are pressed downwardly into the container until the locking tab 37 engages in slot 43, and the flaps are then pulled outwardly into a generally flat position across the bottom of the container. It will be noted that the perf scores 35 in flaps 30A and 30B and the folds 40 and 41 in flap 33 enable these flaps to deform slightly during the folding operation to facilitate set up of the container.

Figure 4:
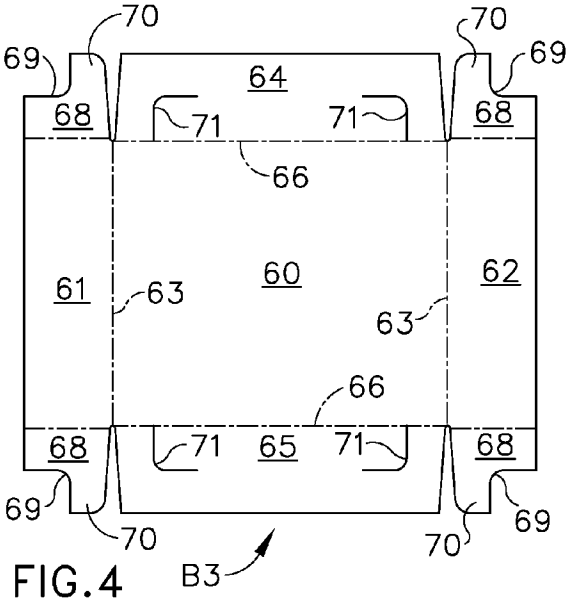
FIG. 4 is a top plan view of a blank for making a cap for use on the container of the invention.

A blank B3 for making the cap 20 is shown in FIG. 4. The blank comprises a rectangular center panel 60 with substantially identical end flaps 61 and 62 foldably joined to opposite end edges thereof along folds 63, and substantially identical side flaps 64 and 65 foldably joined to opposite side edges thereof along folds 66. As seen in FIG. 1, the flaps 61, 62 and 64, 65 interlock with one another to form a cap skirt 67. The interlocking construction of cap 20 is substantially the same as that for the liner tray 110 disclosed in U.S. Pat. No. 7,172,108. Thus, flaps 61 and 62 each has an assembly flap 68 on opposite side edges thereof, with an outer corner cut away at 69 to define a locking tab 70 that is inserted into angled slit cuts 71 in the flaps 64 and 65 adjacent opposite ends thereof.

While particular embodiments of the invention have been illustrated and described in detail herein, it should be understood that various changes and modifications may be made in the invention without departing from the spirit and intent of the invention as defined by the appended claims.

What is claimed is:

1. A reinforced cross laminated bulk container made of corrugated paperboard and having a rectangular configuration, said container comprising:

an outer corrugated component having opposed sidewalls and opposed end walls joined together along vertical scores at corners of the container, said sidewalls and end walls having top, bottom and side edges, and said outer component having corrugations running in a first direction;

an inner corrugated liner laminated to the outer component and having opposed sidewalls and opposed end walls joined together along vertical scores at corners of the container, said sidewalls and end walls having top, bottom and side edges substantially coterminous with the top, bottom and side edges of the respective side and end walls of said outer component, and said inner liner having corrugations running in a second direction perpendicular to the first direction; and said outer component and said inner liner each having at least one reinforcing strand therein extending perpendicular to the corrugations thereof, wherein said at least one reinforcing strand in said liner extends perpendicular to and crosses the at least one reinforcing strand in said outer component.

2. A container as claimed in claim 1, wherein:

at least two said vertical scores disposed diagonally opposite to one another in said inner liner and in said outer component comprise double scores to relieve stress in said scores when said container is moved between an opened up tubular configuration and a flattened configuration.

3. A container as claimed in claim 2, wherein:

bottom flaps are foldably joined to the bottom edges of said outer component to at least partially close the bottom of said container.

4. A container as claimed in claim 3, wherein:

top flanges are foldably joined to the top edges of said outer component to at least partially close the top of said container.

5. A container as claimed in claim 1, wherein:

said sidewalls have a greater width dimension than said end walls;

the corrugations of said outer component extend vertically and the corrugations of said inner liner extend horizontally;

said at least one reinforcing strand in said outer component extends horizontally substantially midway between the top and bottom edges thereof; and said at least one reinforcing strand in said inner liner comprises at least one reinforcing strand extending vertically in each said sidewall substantially midway between opposite side edges thereof.

6. A container as claimed in claim 5, wherein:

said at least one reinforcing strand comprises a plurality of reinforcing strands in each of said inner liner and said outer component.

7. A container as claimed in claim 6, wherein:

at least two said vertical scores disposed diagonally opposite to one another in said inner liner and in said outer component comprise double scores to relieve stress in said scores when said container is moved between an opened up tubular configuration and a flattened configuration.

8. A container as claimed in claim 7, wherein:

bottom flaps are foldably joined to the bottom edges of said outer component to at least partially close the bottom of said container.

9. A container as claimed in claim 8, wherein:

top flanges are foldably joined to the top edges of said outer component to at least partially close the top of said container.

10. A container as claimed in claim 1, wherein:

bottom flaps are foldably joined to the bottom edges of said outer component to close the bottom of said container, said bottom flaps comprising a pair of opposed inner flaps that extend inwardly across the bottom of the container toward and into overlapping relationship with one another, and a pair of opposed outer flaps that extend inwardly across the bottom of the container toward and into overlapping relationship with one another, said outer flaps having an interlocking structure to lock the bottom flaps in closed position across the bottom of the container.

11. A container as claimed in claim 10, wherein:

said interlocking structure comprises a locking slot formed in a first of said outer flaps, and cut away opposite side edges of an opposed second said outer flap defining a projecting locking tab on a free outer end edge of said second outer flap, said locking tab being engaged in said locking slot.

12. A container as claimed in claim 11, wherein:

said locking slot is substantially chevron shaped so that force exerted on said tab by weight of product in said container is distributed non-linearly to inhibit bending of said locking tab.

13. A container as claimed in claim 12, wherein:

diagonal folds extend across said second outer flap from spaced locations at an outer free edge thereof to adjacent opposite ends of the folded connection of said second outer flap to said outer component, defining triangular outer corners on said second outer flap that deflect to facilitate movement of the bottom flaps relative to one another during set up of the container.

14. A container as claimed in claim 13, wherein:

a line of perforations extends across each said inner flap adjacent its folded connection with said outer component to permit deflection of said inner flaps as they are being moved into operative folded positions across the bottom of said container.

15. A container as claimed in claim 1, wherein:

at least some of the vertical scores in said inner liner are pre-broken prior to lamination of the inner liner to the outer component to facilitate fabrication of said container and to make it easier for a user to open the container from a flattened position into its expanded operative position.

16. A container as claimed in claim 15, wherein:

at least two said vertical scores disposed diagonally opposite to one another in said inner liner and in said outer component comprise double scores to relieve stress in said scores when said container is moved between an opened up tubular configuration and a flattened configuration.

17. A blank of corrugated paperboard for making a reinforced bulk container, comprising:

an outer component having a plurality of sidewall panels and end wall panels foldably joined together along spaced parallel scores, said plurality of sidewall panels and end wall panels having top and bottom edges;

said outer component having corrugations extending perpendicular to said top and bottom edges;

at least one reinforcing strand extending across said outer component perpendicular to said corrugations and approximately midway between said top and bottom edges;

an inner liner having a plurality of sidewall panels and end wall panels foldably joined together along spaced parallel scores is laminated to said outer component, said plurality of sidewall panels and end wall panels of said liner having top and bottom edges;

said liner having corrugations extending parallel to said top and bottom edges thereof; and at least one reinforcing strand extending across at least one of said plurality of sidewall panels perpendicular to said corrugations and approximately midway between opposite side edges of said at least one of said plurality of sidewall panels.

18. A blank as claimed in claim 17, wherein:

top flanges are foldably joined to said top edges of said plurality of sidewall panels and end wall panels, said top flanges having interlocking structure for locking them together in a container erected from said blank.

19. A blank as claimed in claim 18, wherein:

bottom flanges are foldably joined to said bottom edges of said plurality of sidewall panels and end wall panels, said bottom flanges having interlocking structure for locking them together in a container erected from said blank.

20. A blank as claimed in claim 17, wherein:

at least some of said spaced parallel scores in said inner liner are pre-broken prior to lamination of said inner liner to said outer component.

* * * * *